US008035663B2

(12) United States Patent
Ishii et al.

(10) Patent No.: US 8,035,663 B2
(45) Date of Patent: Oct. 11, 2011

(54) IMAGE DISPLAY DEVICE

(75) Inventors: Masato Ishii, Tokyo (JP); Naruhiko Kasai, Yokohama (JP); Mitsuhide Miyamoto, Kawasaki (JP); Tohru Kohno, Kokubunji (JP); Hajime Akimoto, Kokubunji (JP)

(73) Assignee: Hitachi Displays, Ltd., Chiba (JP)

( * ) Notice: Subject to any disclaimer, the term of this patent is extended or adjusted under 35 U.S.C. 154(b) by 813 days.

(21) Appl. No.: 12/123,493

(22) Filed: May 20, 2008

(65) Prior Publication Data

US 2008/0291224 A1 Nov. 27, 2008

(30) Foreign Application Priority Data

May 23, 2007 (JP) ..... 2007-136513

(51) Int. Cl.
*G09G 5/10* (2006.01)

(52) U.S. Cl. ..... 345/690; 345/76; 345/77; 345/82

(58) Field of Classification Search ..... 345/76, 345/77, 82, 83, 690
See application file for complete search history.

(56) References Cited

U.S. PATENT DOCUMENTS

| | | | | |
|---|---|---|---|---|
| 6,809,710 | B2 * | 10/2004 | Prache et al. | 345/82 |
| 2004/0090402 | A1 * | 5/2004 | Cheng | 345/77 |
| 2007/0290958 | A1 * | 12/2007 | Cok | 345/77 |

FOREIGN PATENT DOCUMENTS

| | | |
|---|---|---|
| JP | 2000-200073 | 7/2000 |
| JP | 2000-200074 | 7/2000 |
| JP | 2000-200075 | 7/2000 |
| JP | 2000-200076 | 7/2000 |
| JP | 2002-251161 | 9/2002 |
| JP | 2003-5709 | 1/2003 |
| JP | 2003-195837 | 7/2003 |
| JP | 2003-308042 | 10/2003 |
| JP | 2003-330415 | 11/2003 |
| JP | 2003-330416 | 11/2003 |
| JP | 2003-330422 | 11/2003 |
| JP | 2004-109718 | 4/2004 |
| JP | 2006-91709 | 4/2006 |
| JP | 2006-293403 | 10/2006 |
| JP | 2006-324537 | 11/2006 |

* cited by examiner

*Primary Examiner* — Kevin M Nguyen
*Assistant Examiner* — Sepideh Ghafari
(74) *Attorney, Agent, or Firm* — Antonelli, Terry, Stout & Kraus, LLP.

(57) ABSTRACT

With the use of pixel control parts for controlling display elements in response to display data using a display-use voltage source and display control parts for supplying the display data to the pixel control parts, the display data is displayed on a display part. Further, the display data is corrected by detecting states of the display elements. A voltage of the display-use voltage source is preliminarily set to a fixed higher voltage, and a gray scale of the display data is elevated in response to a degradation state of the display element. Accordingly, it is possible to perform a display while maintaining the maximum brightness even when the display element is degraded. Further, the contrast can be maintained by correcting the gray scales of the display data by performing only the digital calculation.

10 Claims, 10 Drawing Sheets

| degradation rate | threshold voltage [mV] | | |
|---|---|---|---|
| | Red | Green | Blue |
| 1% | 10 | 8 | 5 |
| 2% | 20 | 16 | 10 |
| 3% | 30 | 24 | 15 |
| 4% | 40 | 32 | 20 |
| 5% | 50 | 40 | 25 |
| 6% | 60 | 48 | 30 |
| 7% | 70 | 56 | 35 |
| 8% | 80 | 64 | 40 |
| 9% | 90 | 72 | 45 |
| 10% | 100 | 80 | 50 |

61 62

FIG.11
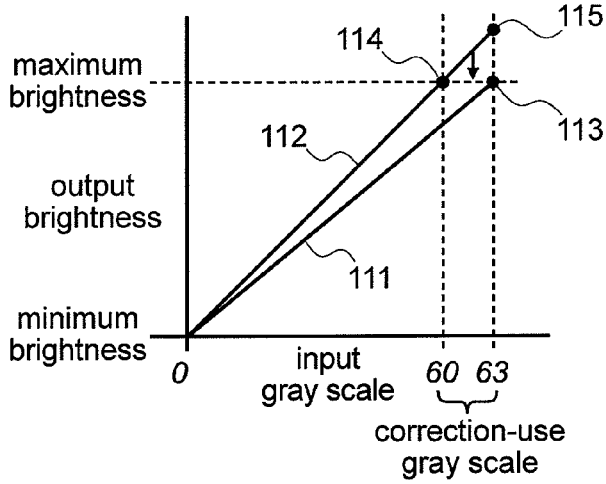
FIG.12A
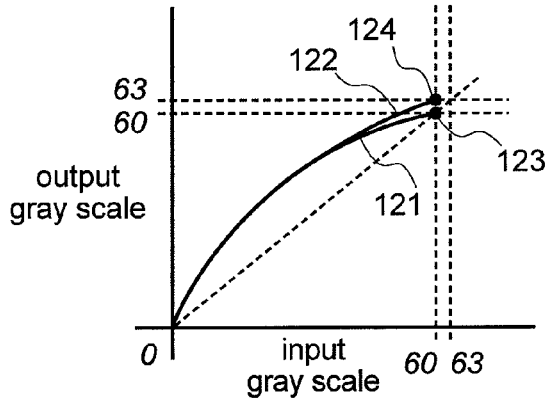
FIG.12B
| input gray scale | gamma correction | conversion |
|---|---|---|
| 0 | 0 | 0 |
| 1 | 1 | 1 |
| | | |
| 54 | 58 | 57 |
| 55 | 58 | 58 |
| 56 | 59 | 59 |
| 57 | 59 | 60 |
| 58 | 59 | 61 |
| 59 | 60 | 62 |
| 60 | 60 | 63 |

FIG.13

| mode | corrected threshold value selection (%) | | |
|---|---|---|---|
| | Red | Green | Blue |
| 1 | 1 | 1 | 1 |
| 2 | 1 | 1 | 2 |
| 3 | 2 | 2 | 2 |

131 132

IMAGE DISPLAY DEVICE

CLAIM OF PRIORITY

The present application claims priority from Japanese application serial no. 2007-136513 filed on May 23, 2007, the content of which is hereby incorporated by reference into this application.

BACKGROUND OF THE INVENTION

1. Field of the Invention

The present invention relates to an image display device which can control brightness in response to a quantity of electric current which is applied to display elements or a light emission time, and more particularly to an image display device having self-luminous light elements represented by organic EL (Electro Luminescence) elements or organic light emitting diodes (OLED) as the display elements.

2. Description of the Related Art

Thanks to the popularization of various information processing devices, various image display devices exist corresponding to roles. Among these image display devices, a self-luminous image display device has been attracting attentions, and an organic EL display has been attracting attentions particularly. Light emitting elements such as OLEDs used in the device are self-luminous and hence, a backlight is unnecessary whereby the organic EL display is suitable for lowering the power consumption. Further, the organic EL display possesses advantages such as the high visibility of pixels or a rapid response speed compared to a conventional liquid crystal display. Further, the light emitting diode has characteristics similar to characteristics of a diode and can control brightness in response to a quantity of electric current which flows in the element. A driving method of such a self-luminous image display devices is disclosed in JP-A-2006-91709 or the like.

As the characteristic of the light emitting element, an inner resistance value of the light emitting element changes depending on a use period or a surrounding environment. Particularly, the light emitting element possesses the characteristic that when the use period is prolonged, the inner resistance of the display element is increased with time so that an electric current which flows in the display element is decreased. Accordingly, for example, when the pixels on the same portion within a screen such as the pixels which form a menu display are turned on, a phenomenon that burn-in appears in the portion arises. In the conventional correction of such a phenomenon, there has been known a method which detects a state of the pixels at the time of starting the image display device, holds the detected state in a memory, and superposes a differential between the display data and the held detection value at the time of operating the image display device to the display data. With the use of such a correction method, however, when the pixels are degraded in spite of a demand for the maximum brightness based on the display data, the pixels cannot perform a display of more brightness. Accordingly, there arises a drawback that the maximum brightness is lowered, that is, contrast is lowered.

SUMMARY OF THE INVENTION

It is an object of the present invention to prevent lowering of contrast by allowing pixels to maintain the maximum brightness even when the correction is made while the pixels are degraded.

The present invention is characterized by preliminarily setting the maximum brightness after the degradation of a display element and changing a dynamic range of display data corresponding to a degree of degradation of the display element thus holding the maximum brightness of a display element. Further, the present invention is also characterized by holding the maximum brightness and the contrast by correcting the display data by performing only a digital calculation.

According to the present invention, in the correction of burn-in, it is possible to prevent the gray scale collapse after correction by preliminarily changing the dynamic range of display data before correction. According to embodiments 1 and 2, it is possible to eliminate the burn-in phenomenon while holding the maximum brightness. Further, according to an embodiment 3, it is possible to eliminate the burn-in phenomenon without lowering the contrast. According to an embodiment 4, it is possible to perform the gamma correction in a compatible manner with the correction of burn-in. According to a fifth embodiment, it is possible to perform the correction as viewed with naked eyes due to the adjustment of correction quantities of R, G, B independently. The present invention is applicable to a display unit as a single unit, a built-in panel in which the display device is incorporated, or a display device of a portable digital assistant.

BRIEF DESCRIPTION OF THE DRAWINGS

FIG. 11 is an explanatory view of another operation of the correction calculation circuit shown in FIG. 2;

FIG. 12A and FIG. 12B are explanatory views of another operation of the correction calculation circuit shown in FIG. 2; and FIG. 13 is a view showing a correction method different from a correction method shown in FIG. 7.

DESCRIPTION OF THE PREFERRED EMBODIMENT

Embodiments of the present invention are explained in conjunction with drawings hereinafter.

Embodiment 1

Figure 1:
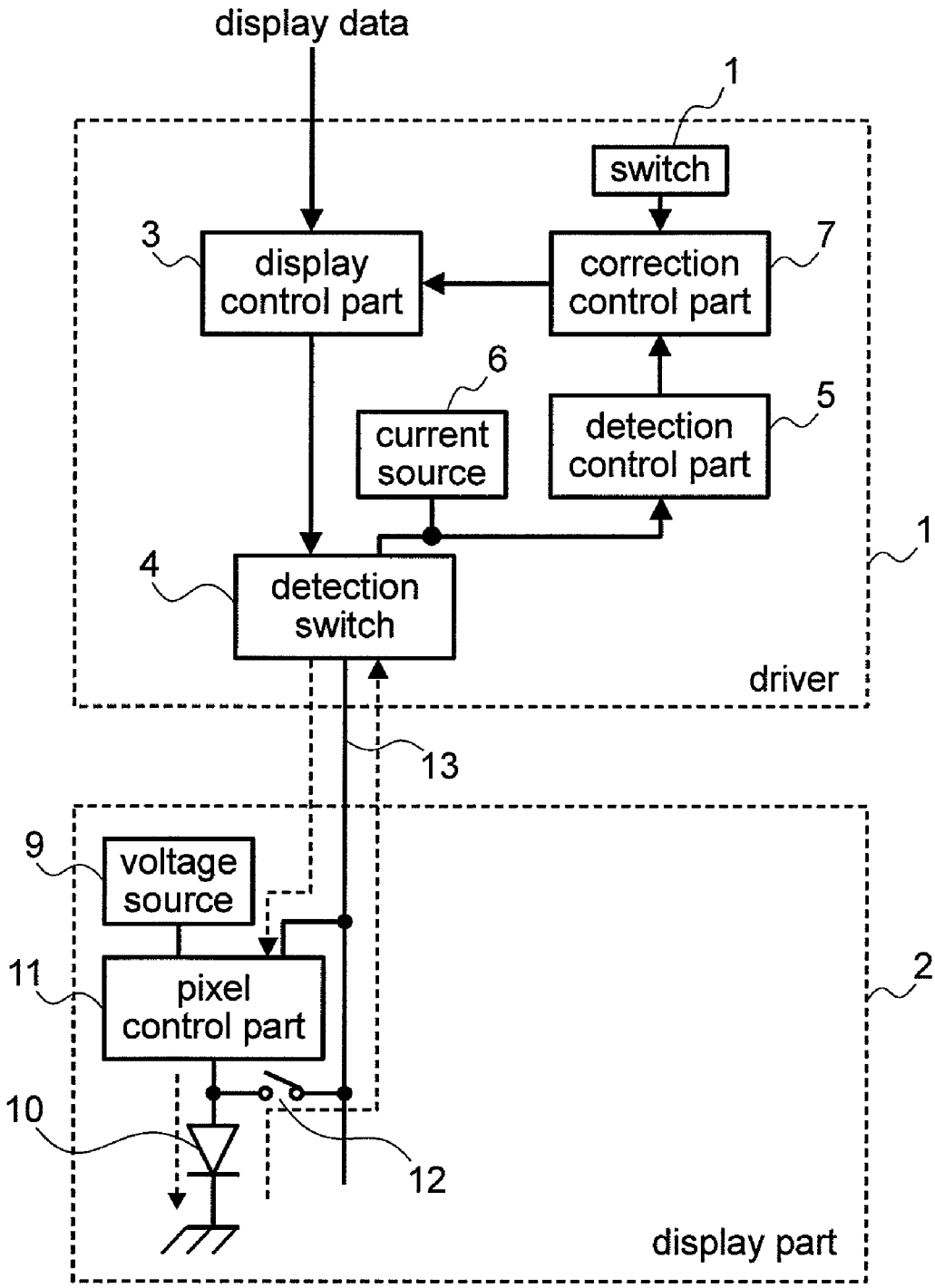
FIG. 1 is an overall constitutional view of a display panel part.

FIG. 1 is an overall constitutional view of a display panel part. In FIG. 1, the display panel part is constituted of a driver 1 and a display part 2. The driver 1 includes a display control part 3, a detection switch 4, a detection control part 5, a detection-use current source 6, a correction control part 7, and a correction selection switch 8. The display part 2 includes a display-use voltage source 9, display elements 10, pixel control parts 11, and selection switches 12. The driver 1 and the display part 2 are connected with each other using a bus 13. The detection-use current source 6 is provided to a signal line which connects the detection control part 5 and the detection switch 4, and the detection control part 5 detects a voltage change of the display element 10 on the signal line. Display data from the outside is inputted to the display control part 3 of the driver 1. The display control part 3 performs a timing control and a signal control of an input signal. The display-use voltage source 9 is connected to the display elements 10 via the pixel control parts 11. Further, the detection switch 4 and the pixel control parts 11 are also connected to each other.

Next, the manner of operation of the display panel part shown in FIG. 1 is explained. A flow of a signal in the inside of the driver 1 is, as indicated by dotted lines in FIG. 1, substantially constituted of three kinds of paths, that is, a display path, a detection path and a correction path. The display path is the flow of display data through the display control part 3, the detection switch 4 and the bus 13 in the driver 1 and the pixel control part 11 in the display part 2 which allows the display-use voltage source 9 to drive the display element 10. The detection path is the flow of display data which arrives at the detection control part 5 from the display element 10 through the selection switch 12 and the bus 13 in the display part 2 and the detection switch 4 in the driver 1. The correction path is the flow of display data which arrives at the display control part 3 from the detection control part 5 through the correction control part 7 for correcting the display data.

Here, the detection switch 4 is provided for changing over the direction of data between the time of display and the time of detection. The display-use voltage source 9 is used at the time of display, while the current source 6 is used at the time of detection. At the time of display, the pixel control part 11 controls the display-use voltage source 9 corresponding to the display data for driving the display element 10, while at the time of detection, with the use of the detection-use current source 6, a state of a voltage change of the display element 10 is transmitted to the detection control part 5.

Although the number of power sources is two in this embodiment, the number of the power sources is increased or decreased depending on the constitution of the display panel part. Further, also with respect to the kinds of the power sources, the electric source, the voltage source or the like may be changed depending on the constitution of the display panel part. Further, the correction selection switch 8 in the driver 1 is provided for selecting correction information which the correction control part 7 calculates. When the correction calculation is fixed, the correction selection switch 8 is unnecessary. On the other hand, the correction selection switch 8 may preferably be used when the display panel part is configured such that a user can select a calculation method.

Figure 2:
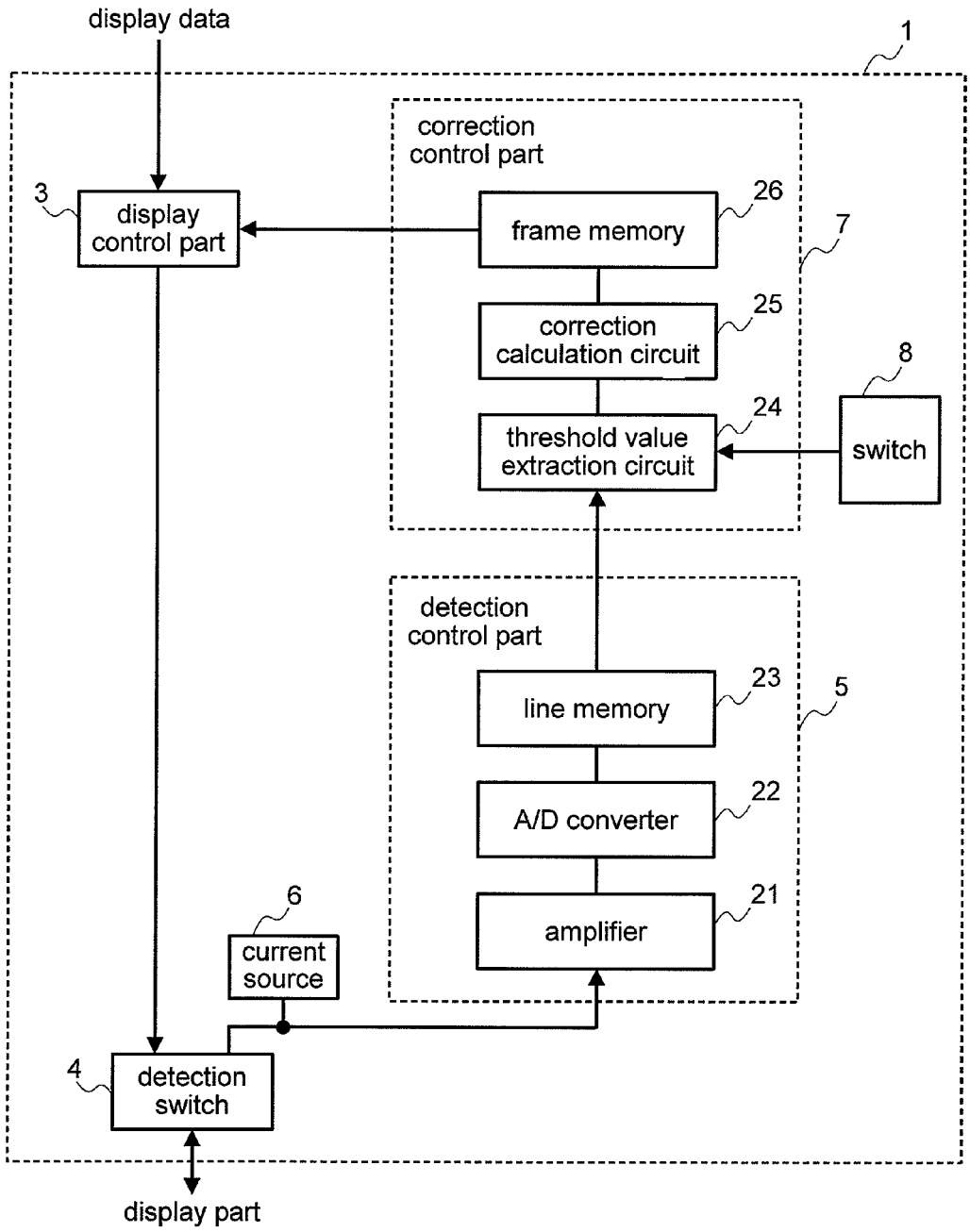
FIG. 2 is a constitutional view of a driver shown in FIG. 1.

FIG. 2 is a constitutional view of the driver 1 shown in FIG. 1. In FIG. 2, the driver 1 includes, in the same manner as the driver 1 shown in FIG. 1, the display control part 3, the detection switch 4, the detection control part 5, the detection-use current source 6, the correction control part 7, and the correction selection switch 8.

The detection control part 5 includes an amplifier 21 for amplifying a signal which is a detection result, an A/D converter 22 and a line memory 23 for temporarily storing a conversion result. Here, to explain the manner of operation of the detection control part 5, a signal which flows through the detection switch 4 from the display part 2 shown in FIG. 1 is extremely fine in many cases. Accordingly, the amplifier 21 is used in order to stably transmit this extremely fine signal to a subsequent stage. Thereafter, the detected data is converted into a digital value by the A/D converter 22, and the detected data for 1 line is stored in the line memory 23. In storing the detected data in the line memory 23, data processing such as averaging of the detected data or extraction of a minimum value of the detected data may be applied to the detected data.

The correction control part 7 includes a threshold value extraction circuit 24 for classifying normal data and degradation data from the detected data, a correction calculation circuit 25 for calculating a correction value, and a frame memory 26 for storing a calculation result. As a calculation example of the threshold value acquired by the threshold value extraction circuit 24, a table includes threshold values and the threshold values are calculated based on an average or standard deviation of detected data for 1 line. Further, the correction selection switch 8 may be used for selecting or adjusting the calculation methods. The calculation methods by the correction calculation circuit 25 are described later. The correction data calculated by the correction calculation circuit 25 is stored in the frame memory 26. Here, the calculation result acquired by the correction calculation circuit 25 may be directly transmitted to the display control part 3 as the correction data and the display control part 3 may correct the display data. In this case, the frame memory 26 is unnecessary.

Figure 3A:
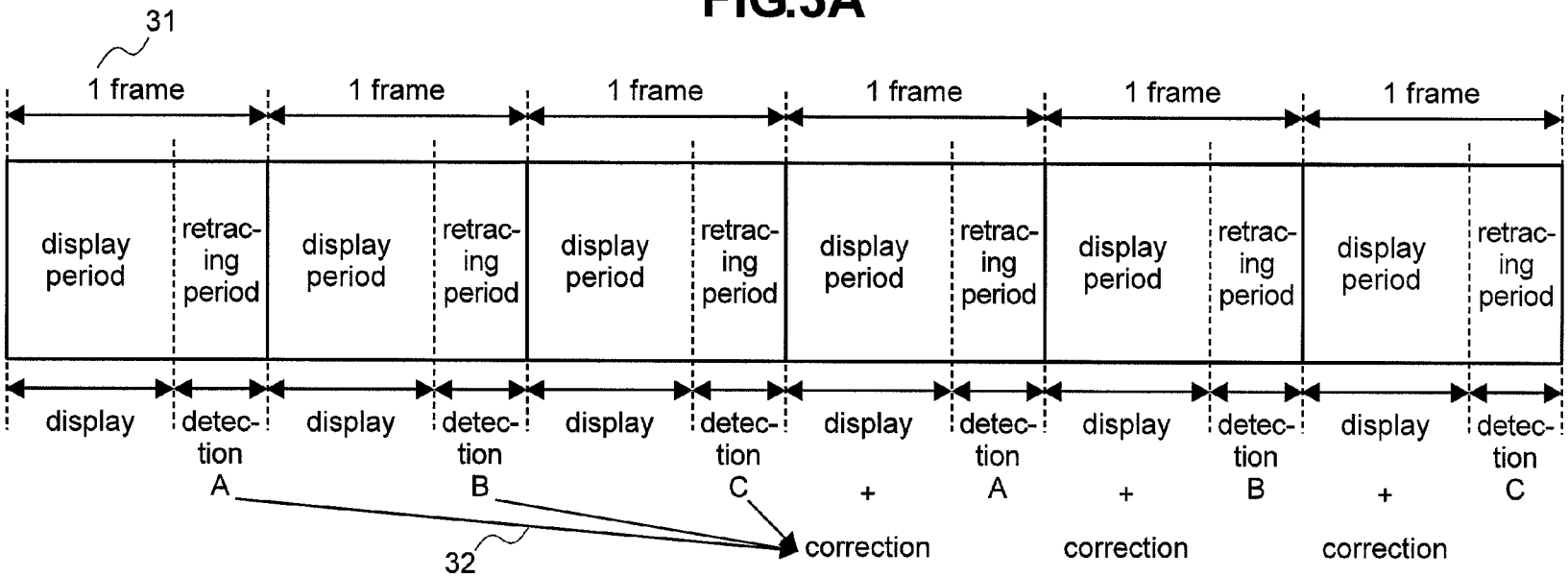
FIG. 3A and FIG. 3B are timing charts for performing the display, the detection and the correction.
Figure 3B:
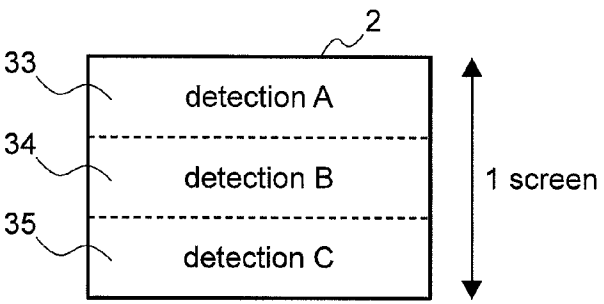

FIG. 3A and FIG. 3B are timing charts for performing the display, the detection and the correction. FIG. 3A is the timing chart ranging over several frames, wherein timing 31 indicates a state of 1 frame period, and timing 32 indicates a state that the detection is performed in a retracing period in 1 frame period and the correction is performed in the display period. Most of image display devices adopt a display period and a retracing period. In this embodiment, the display is performed in the display period, and the detection is performed in the retracing period. Further, the retracing period is shorter than the display period and hence, there exists a possibility that the state of display elements corresponding to the whole pixels cannot be detected within the retracing period of 1 frame. In this case, the detection is performed over the several frames.

Accordingly, as shown in FIG. 3B, one screen in the display part 2 is divided into a plurality of blocks, wherein the detection A is performed in the block 33, the detection B is performed in the block 34 and the detection C is performed in the block 35, for example. Only 1 block is detected during 1 frame period. In this example, a detection result acquired by detection in certain 3 frames is stored in the frame memory, and the result is treated as the correction data in the subsequent 3 frame and the display data is corrected. Further, by performing the detection within 1 frame, the correction can be performed for every frame. Further, besides such an example, at the time of starting an operation of the image display device, no display period is provided, and the whole 1 frame is formed of the detection period, and the correction is collectively performed at the time of starting the operation of the image display device.

Figure 4A:
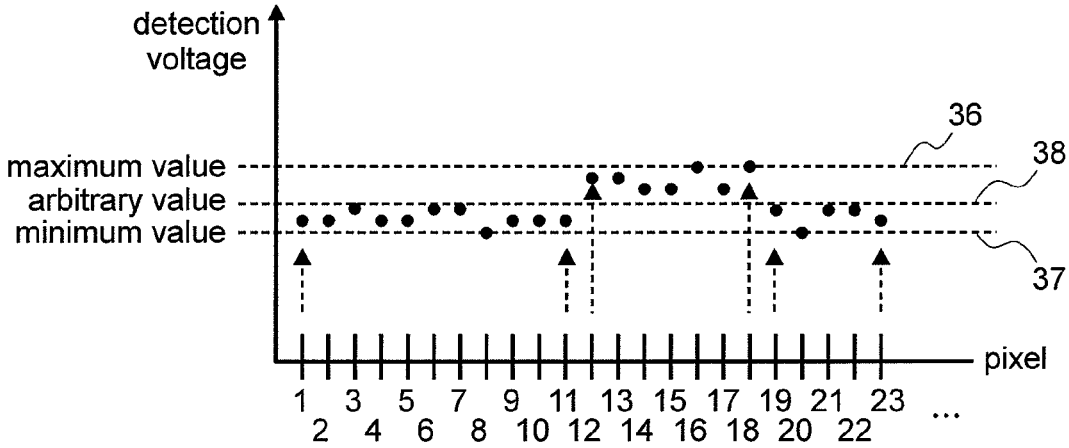
FIG. 4A and FIG. 4B are explanatory views of an operation of a threshold value extraction circuit shown in FIG. 2.
Figure 4B:
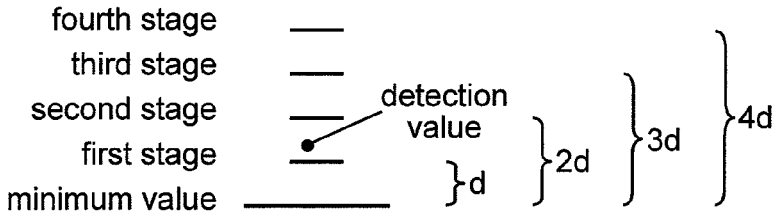

FIG. 4A and FIG. 4B are explanatory views of an operation of the threshold value extraction circuit 24 shown in FIG. 2. The explanation is made with respect to a case in which a threshold value is set and a correction method is performed based on a detection value. FIG. 4A shows a state in which the 12th to 18th pixels are degraded. As a method of correcting such a state, a method which sets a dotted line 36 indicative of a maximum value as a threshold value, a method which sets a dotted line 37 indicative of a minimum value as a threshold value, and a method which sets a dotted line 38 indicative of an arbitrary value as a threshold value are considered. Any one of these correction methods may be selected. In setting the threshold value, a method for setting an average value or other method may be adopted. Further, in setting the dotted line 38 indicative of the arbitrary value, the correction selection switch 8 may be used.

FIG. 4B shows a case in which the minimum value is selected as the correction threshold value. In this correction, when the detection value exceeds a value of a set quantity d from the minimum value, it is considered that the pixel is degraded and the correction processing is performed. Further, at a point of time that the detection value exceeds a set quantity 2*d*, 3*d*, 4*d*, the correction is performed by changing a correction quantity. The set quantity d and the correction quantity assume values different from each other. As shown in FIG. 4B, when the detection value falls between a first stage and a second stage, the correction of the first stage is performed. When the correction of the second stage is performed here, the correction becomes the excessive correction. However, there may be a case that when the correction of the first stage close to the second stage is performed, the correction of the first stage may be considered appropriate as viewed with naked eyes and hence, the arbitrary correction may be adopted in such a case.

Figure 5A:
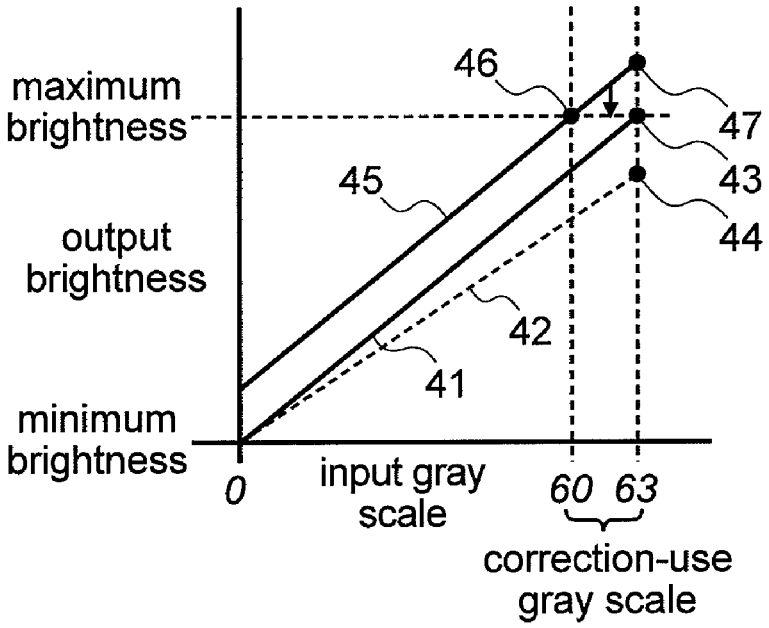
FIG. 5A and FIG. 5B are explanatory views of an operation of a correction calculation circuit shown in FIG. 2.
Figure 5B:
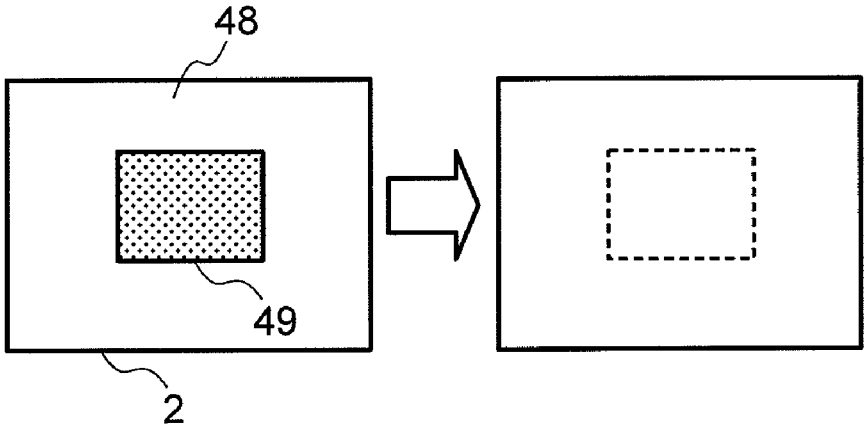

FIG. 5A and FIG. 5B are explanatory views of an operation of the correction calculation circuit 25 shown in FIG. 2. That is, FIG. 5 shows the method which uses a maximum value of the detection value as the threshold value. FIG. 5A is a graph of output brightness corresponding to an inputted gray scale. In this embodiment, the explanation is made with respect to the gray scales of 6 bits, that is, 64 gray scales (0 to 63). However, the number of bits for the gray scales may be arbitrarily set.

A solid line 41 shown in FIG. 5A indicates that the relationship between the input gray scale and the output brightness is set to a fixed value. In this case, the minimum brightness is acquired at the 0th gray scale and the maximum brightness is acquired at the 63rd gray scale. A dotted line 42 shown in FIG. 5A shows the degradation of brightness generated by burn-in. This burn-in phenomenon is a phenomenon induced by the degradation of the display element (pixel) and implies that the inner resistance of the pixel is changed. Since the brightness of the pixel is determined based on a current quantity, assuming that a voltage applied to the pixel is fixed, when the inner resistance of the pixel is changed, the current quantity is changed thus also changing the brightness. That is, the voltage applied to the pixel is set to a fixed value corresponding to the gray scale and hence, when the inner resistance of the pixel is increased due to degradation, a quantity of an electric current which flows in the pixel is decreased.

In the 63rd gray scale, when the brightness 43 on the solid line 41 is degraded, the brightness 43 is changed to the brightness 44 on the dotted line 42. Accordingly, FIG. 5A shows that the brightness is lowered even when the voltage is controlled at the same gray scale in such a state. In this case, between the non-degraded pixel of the 63rd gray scale and the degraded pixel of the 63rd gray scale, the brightness difference between the brightness 43 and the brightness 44 is generated. Accordingly, by applying the correction to the non-degraded pixel to assume the dotted line 42, the brightness difference can be eliminated. However, a drawback of this method lies in that the maximum brightness is lowered, and the contrast is lowered along with the degradation of the pixel. To correct this lowered maximum brightness, it may be possible to adopt a method which increases a voltage applied to the pixel or a method which changes a gray-scale voltage. However, these methods generate an analogue voltage using a voltage generation circuit and change the generated analogue voltage and hence, an analogue control becomes complicated.

In this embodiment, the control is simplified by adopting a digital control in place of the analogue control. That is, the control indicated by a solid line 45 shown in FIG. 5A is performed. The control is explained in conjunction with a method for setting a power source voltage of the display-use voltage source 9.

When the solid line 45 is translated, the power source voltage is set such that the brightness 46 at the 60th gray scale and the brightness 43 at the 63rd gray scale become equal to each other and, at the same time, the brightness 47 which exceeds the maximum brightness is acquired at the 63rd gray scale on the solid line 45. This power source voltage is not changed after being set.

Here, 4 gray scales ranging from the 60th gray scale to the 63rd gray scale, that is, the gray scales corresponding to 2 bits are used as correction-use gray scales. In an initial state with no degradation of brightness, the display data ranging from the 0th gray scale to the 63rd gray scale is converted into a display data ranging from the 0th gray scale to the 60th gray scale, and the maximum brightness is maintained. Thereafter, when the brightness 47 is lowered toward the brightness 43 due to the degradation of brightness and a degradation rate exceeds an amount corresponding to 1 gray scale, the converted gray scales of the display data are increased by 1 gray scale. That is, the display data ranging from the 0th gray scale to the 60th gray scale is converted into display data ranging from the 0th gray scale to the 61st gray scale.

In this manner, the higher power source voltage is preliminarily set to the pixel such that the brightness 47 exceeding the maximum brightness is acquired at the 63rd gray scale in an initial state. Then, at the time of performing the correction, the gray scales of the display data are increased such that the degraded pixel maintains the maximum brightness. That is, the power source voltage applied to the pixel is set to a fixed value, and when the pixel is degraded, the gray scales of the display data are increased without elevating the power source voltage. Due to such a control, the degradation correction of 4 stages ranging from the 60th gray scale to the 63rd gray scale can be performed with the digital correction. In this manner, a dynamic range of the display data can be changed corresponding to a degree of degradation of the pixel.

Here, this embodiment may also adopt a method which performs the correction of 1 gray scale when the brightness is degraded by 1% as another index of 1 gray scale. In this manner, any index may be used for correcting the degradation of brightness corresponding to 1 gray scale and, further, the number of bits used in the correction can be arbitrarily set.

FIG. 5B shows a degradation correction state of a display screen. In a state before the correction, a normal region 48 and a degraded region 49 are present in the display part 2. In this embodiment, the brightness of the degraded region 49 can be corrected to the brightness substantially equal to the brightness of the normal region 48.

Figures 6, 7:
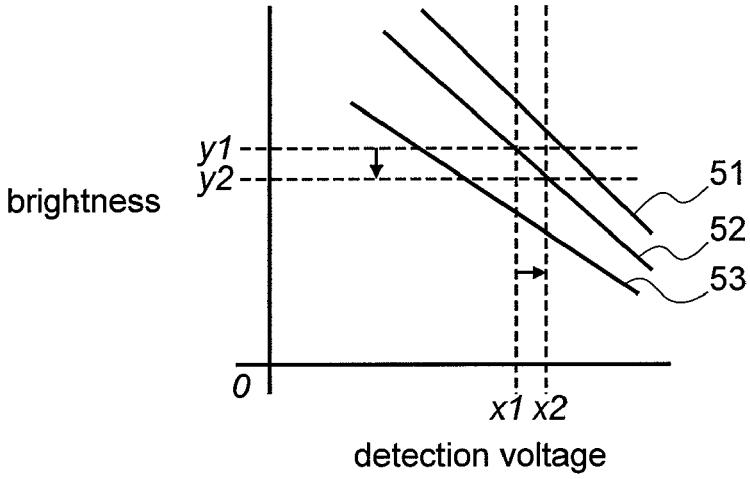
FIG. 6 is a graph showing the relationship between a detection voltage and brightness.
FIG. 7 is a table showing the relationship between degradation rate and a threshold voltage.

FIG. 6 is a graph showing the relationship between a detection voltage and brightness. In general, characteristics of the pixels of R (Red), G (Green), B (Blue) differ from each other depending on conditions such as materials of the respective pixels. In FIG. 6, assume a degradation rate of a Red component of the pixel as a solid line 51, a degradation rate of a Green component of the pixel as a solid line 52 and a degradation rate of a Blue component of the pixel as a solid line 53. Here, for example, on the solid line 52, assume the detection voltage of the brightness y1 as x1, and the detection voltage of the brightness y2 as x2. When the brightness y2 is degraded by 1% compared to the brightness y1, a differential between the detection voltage x1 and the detection voltage x2 becomes a detection voltage with a degradation rate of 1%.

FIG. 7 is a table showing the relationship between the degradation rate and the threshold voltage. As shown in FIG. 6, the degradation rate differs between the Red, Green and Blue components of the pixel in many cases and hence, the threshold voltages which become references with respect to the detection voltages are controlled independently with respect to the R, G, B components of the pixels. A column 61 shown in FIG. 7 indicates the degradation rates, and a column 62 shown in FIG. 7 indicates the threshold voltages of R, G, B components of the pixel. When the degradation characteristic is changed linearly with respect to the brightness, the threshold voltages in the column 62 are set at equal intervals with respect to the degradation rate in the column 61. To the contrary, when the degradation characteristic is changed as a multi-order curve with respect to the brightness, the threshold voltages in the column 62 are not set at equal intervals with respect to the degradation rate in the column 61. Assuming that the correction bit is 2 bits and the degradation correction is performed over 4 stages, the correction up to the degradation rate of 4% can be performed with simple correction. Further, the correction rate may be performed over 4 stages for every 2%.

Figure 8:
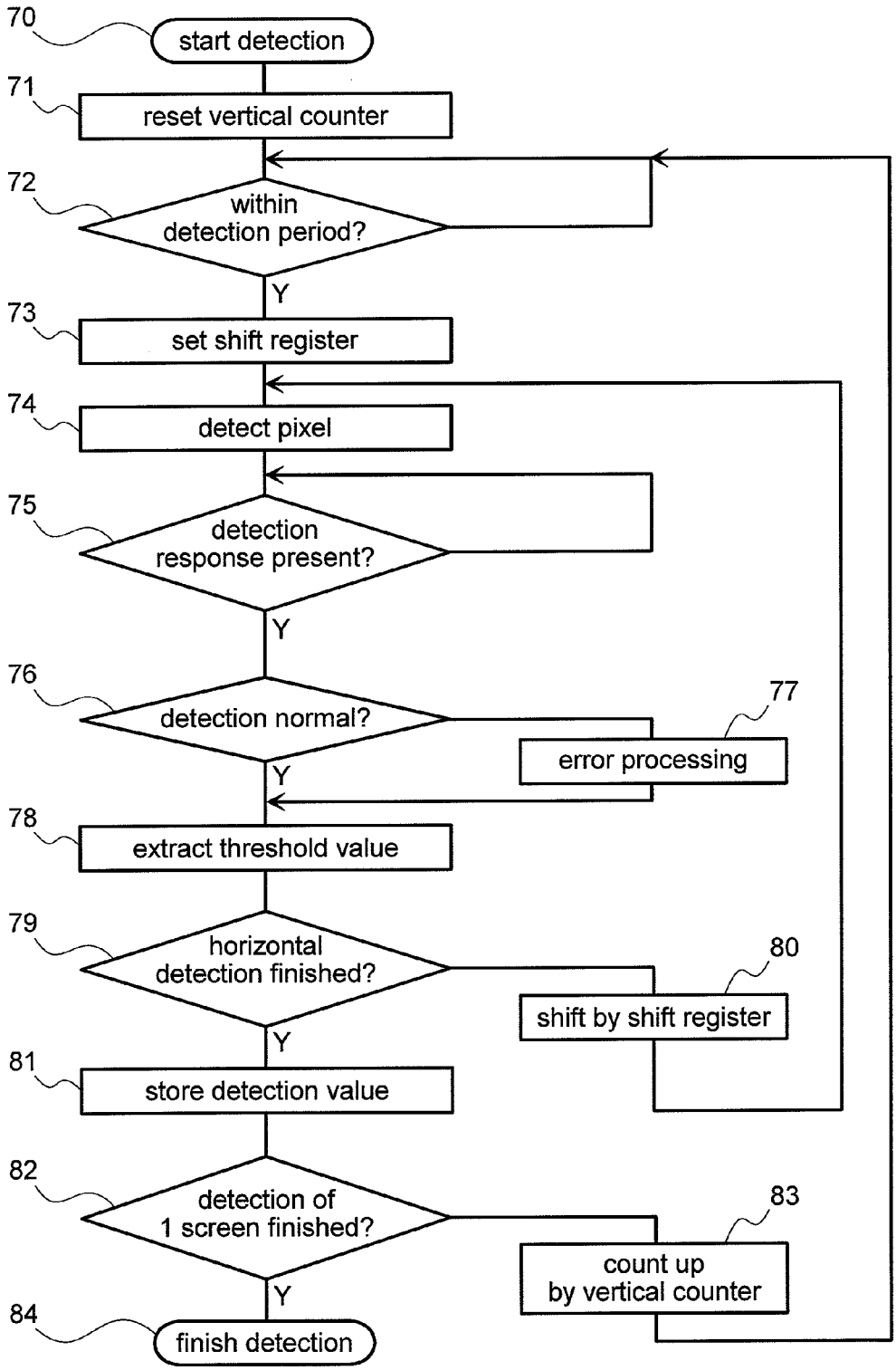
FIG. 8 is a flowchart of detection processing.

FIG. 8 is a flowchart of detection processing. The degradation correction is collectively performed at the time of starting the operation of the image display device. When the detection processing is started in step 70, a vertical counter is reset in step 71. In step 72, it is determined whether or not the processing arrives at the detection period. When the processing arrives at the detection period, a shift register which changes over the respective pixels is set in step 73, and a state of the pixel to be detected is detected in step 74. The processing waits for a detection response in step 75. When the detection response is present, a detection state is determined in step 76. When the detection state is abnormal, error processing is executed in step 77. When it is determined that the detection state is normal in step 76, a threshold value is extracted in step 78. In step 79, it is determined whether or not the detection of 1 line is finished. When the detection is in the midst of 1 line, the shift register is shifted in step 80 a remaining portion of 1 line is detected. When the detection of 1 line is finished in step 79, a detection value is stored in step 81. It is determined whether or not the detection of 1 screen is finished in step 82. When the detection is in the midst of 1 screen, the counting by the vertical counter is counted up in step 83 and a remaining portion of 1 screen is detected. Upon completion of detection of 1 screen in step 82, the detection is finished in step 84.

Figure 9:
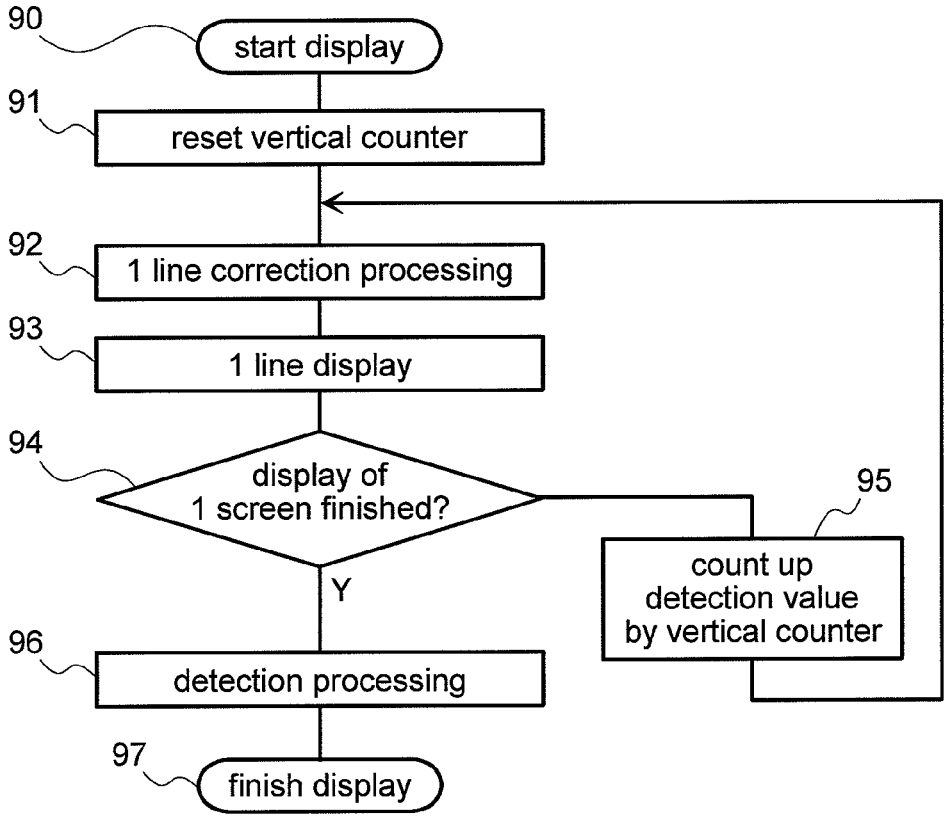
FIG. 9 is a flowchart of display processing.

FIG. 9 is a flowchart of display processing. When the display processing is started in step 90, a vertical counter is reset in step 91. Next, correction processing is executed by calculating a correction value based on the stored detection value and threshold value in step 92. When display data by an amount corresponding to 1 line is acquired, the display processing corresponding to an amount of 1 line is executed in step 93. It is determined whether or not a display of 1 screen is finished in step 94. When the processing is in the midst of 1 screen, counting of a vertical counter is counted up in step 95 and a remaining portion of 1 screen is displayed. Upon completion of display of 1 screen in step 94, the detection processing at the detection A, the detection B or the detection C shown in FIG. 3 is started in step 96. Upon completion of the detection processing, the display processing is finished in step 97. Since the display is constantly performed, the processing returns to step 90 from step 97 in a usual operation.

Embodiment 2

Figure 10:
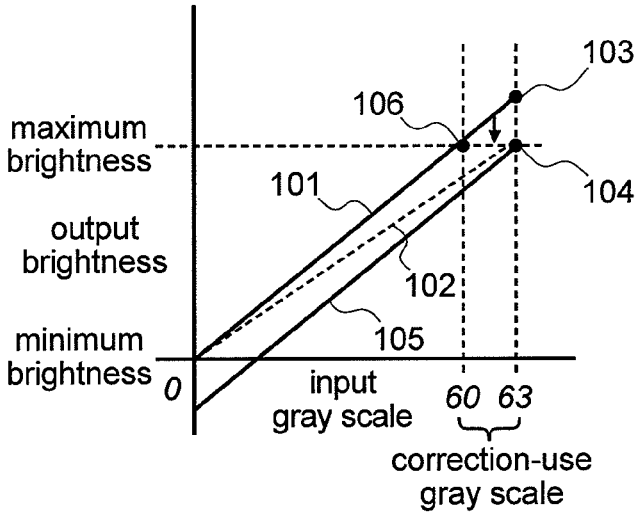
FIG. 10 is an explanatory view of another operation of a correction calculation circuit shown in FIG. 2.

FIG. 10 is an explanatory view of another operation of the correction calculation circuit 25 shown in FIG. 2. The operation explained in conjunction with FIG. 10 differs from the operation of the embodiment 1 explained in conjunction with FIG. 5 with respect to a point that the brightness at the 0th gray scale is not set to the minimum brightness in FIG. 5, while the brightness at the 0th gray scale is set to the minimum brightness in FIG. 10.

When a solid line 101 shown in FIG. 10 is translated, the power source voltage is set such that the brightness 106 at the 60th gray scale and the brightness 10 at the 63rd gray scale become equal to each other and, at the same time, the brightness 103 which exceeds the maximum brightness is acquired at the 63rd gray scale on the solid line 101. This power source voltage is not changed after being set. After setting of the power source voltage, the brightness 103 on the solid line 101 is lowered to the brightness 104 on the solid line 105 corresponding to the degradation of brightness attributed to burn-in. The use of 4 gray scales ranging from the 60th gray scale to the 63rd gray scale as correction-use gray scales corresponding to the lowering of brightness is performed in the same manner as the use of 4 gray scales ranging from the 60th gray scale to the 63rd gray scale as correction-use gray scales in the embodiment 1 explained in conjunction with FIG. 5. Here, a dotted line 102 shown in FIG. 10 indicates that the relationship between the input gray scale and the output brightness is set to a fixed value.

Embodiment 3

FIG. 11 is an explanatory view of another operation of the correction calculation circuit 25 shown in FIG. 2. In the operation of the embodiment 1 explained in conjunction with FIG. 5 or the operation of the embodiment 2 explained in conjunction with FIG. 10, the correction is performed on the solid line 45 or on the solid line 101. The advantage of these corrections lies in that it is sufficient to superimpose the correction-use gray scale to the display data and hence, the circuit can be simplified. However, these corrections have following drawbacks. That is, in the correction on the solid line 45, black assumes the floating state at the 0th gray scale in an initial state and black is gradually deepened due to the correction. Further, in the correction on the solid line 101, although the output brightness is 0 at the 0th gray scale in an initial state, the display data of low gray scales is gradually ignored due to the correction.

Accordingly, in this embodiment, the correction is performed such that the 0th gray scale before the correction is held at the 0th gray scale even after the correction. A solid line 111 shown in FIG. 11 indicates that the relationship between the input gray scale and the output brightness is set to a fixed value. Further, a solid line 112 shown in FIG. 11 indicates the characteristic at the time of correction and the brightness at the 0th gray scale is set to 0. Accordingly, the brightness 115 at the 63rd gray scale on the solid line 112 is set to the brightness which exceeds the maximum brightnesses 113, 114 such that the maximum brightness 113 and the maximum brightness 114 become equal to each other, and advantage of this correction lies in the maintenance of the maximum brightness and the minimum brightness. However, the correction shown in FIG. 11 has a drawback that the calculation of the correction-use gray scales requires multiplication and division and hence, a circuit becomes complicated. Here, by allowing a memory or the like to have the correction factors, the correction can be performed using only the addition and subtraction and hence, a calculation circuit can be simplified.

Embodiment 4

FIG. 12A and FIG. 12B are explanatory views of another operation of the correction calculation circuit 25 shown in FIG. 2. The embodiments 1, 2 and 3 adopt the linear correction. However, image display devices in general adopt the gamma correction. In this embodiment, the explanation is made with respect to the correction to which the gamma correction is added. A curve 121 shown in FIG. 12A indicates the gamma correction used in general, and a curve 122 shown in FIG. 12A indicates the correction which is the combination of the gamma correction and the degradation correction of this embodiment. In this embodiment, the brightness 123 at input gray scale 60 is converted into brightness 124. In the same manner as the embodiment 1, a power source voltage is preliminarily set to a higher value by estimating the degradation of brightness. Further, this gamma correction is also applicable to the embodiments 2 and 3. By adjusting a correction quantity of the degradation correction in conformity with a gray-scale quantity in the gamma correction, the excessive correction attributed to the gamma correction can be obviated. This adjustment can be performed from time to time by allowing the memory to have a table shown in FIG. 12B or by calculation.

Embodiment 5

FIG. 13 is a view showing a correction method different from the correction method of the embodiment 1 shown in FIG. 7. In FIG. 7, the R, G, B components of the pixel share the same degradation rate. In this embodiment, the degradation rates of the R, G, B components of the pixel are set different from each other. Even when the R, G, B components of the pixel exhibit the same lowering of brightness, the lowering of brightness of the respective R, G, B components of the pixel may appear differently with naked eyes of a viewer. For example, although the viewer clearly recognizes the degradation of brightness of 1% with respect to the Red and Green components of the pixel, the viewer may hardly recognizes the degradation of brightness of 1% with respect to the Blue component of the pixel. FIG. 13 shows the constitution which changes over the optimization of the correction quantities of the R, G, B components depending on modes. Several set patterns are prepared as the modes 131, and contents of the set patterns are set in the correction threshold value selection 132. For example, in mode 1, the degradation rate is calculated using the threshold value of 1% which is substantially equal with respect to the R, G, B components. In the mode 2, the degradation rate is calculated by setting the threshold value of the R and G components to 1% and by setting the threshold value of the B component to 2%. Since these modes can be set independently from the correction calculation explained in conjunction with the embodiments 1 to 4, these modes are applicable to any embodiment.

What is claimed is:

1. An image display device comprising:

a display part including a plurality of display elements, a display-use voltage source, pixel control parts for controlling the display elements in response to display data using the display-use voltage source, and selection switches for selecting the display elements for detecting states of the plurality of display elements;

a driver including a detection switch for changing over the display data and state signals from the display elements, a detection-use current source, a detection control part for amplifying the state signals detected using the detection-use current source, for converting the state signals into detection data by digital conversion and for outputting the detection data, a correction control part for extracting a threshold value of the detection data and for outputting the correction data based on the threshold value, and a display control part for converting the display data based on the correction data; and a bus for connecting the display part and the driver, wherein a voltage of the display-use voltage source is preliminarily set to a voltage which exceeds the maximum brightness of the display element, and the correction control part outputs the correction data which changes a dynamic range of display data such that the maximum gray scale of the display data becomes the maximum brightness of the display element.

2. An image display device according to claim 1, wherein the correction control part includes a threshold value extraction circuit which extracts the threshold value of the detection data and a correction calculation circuit for outputting the correction data based on the threshold value.

3. An image display device according to claim 2, wherein the threshold value extraction circuit is configured such that a representative value of the threshold value is selected by a correction selection switch.

4. An image display device according to claim 3, wherein a maximum value, a minimum value or an average value of the detection data is used as the representative value.

5. An image display device according to claim 2, wherein the correction calculation circuit holds the maximum brightness and a minimum brightness of the display element.

6. An image display device according to claim 2, wherein the correction calculation circuit also performs the gamma correction.

7. An image display device according to claim 2, wherein the correction calculation circuit adjusts a correction quantity between a voltage degradation rate of R, G, B and a degradation of brightness rate as viewed by naked eyes.

8. An image display device according to claim 1, wherein the display control part collectively detects a state of the plurality of display elements at the time of starting the operation of the image display device.

9. An image display device according to claim 1, wherein the display control part detects states of some display elements in one screen during a retracing period of 1 frame.

10. An image display device according to claim 9, wherein the detection of the state of some display elements is performed by detecting the state of the display elements in one screen during retracing periods of several frames.

* * * * *